US008490631B2

(12) United States Patent
Chang

(10) Patent No.: US 8,490,631 B2
(45) Date of Patent: Jul. 23, 2013

(54) VAPORIZATION LIGHTER

(76) Inventor: Joe Chang, Carbondale, IL (US)

( * ) Notice: Subject to any disclaimer, the term of this patent is extended or adjusted under 35 U.S.C. 154(b) by 24 days.

(21) Appl. No.: 13/485,961

(22) Filed: Jun. 1, 2012

(65) Prior Publication Data

US 2012/0325229 A1 Dec. 27, 2012

Related U.S. Application Data

(60) Provisional application No. 61/501,260, filed on Jun. 27, 2011.

(51) Int. Cl.
*A24F 13/00* (2006.01)
*A24F 17/00* (2006.01)

(52) U.S. Cl.
USPC ..... 131/329; 131/194; 131/196; 131/271; 431/344

(58) Field of Classification Search
None
See application file for complete search history.

(56) References Cited

U.S. PATENT DOCUMENTS

| | | | | |
|---|---|---|---|---|
| 2,405,952 | A * | 8/1946 | High et al. | 126/401 |
| 6,439,224 | B1 * | 8/2002 | Farone | 126/271.1 |
| 6,536,442 | B2 * | 3/2003 | St. Charles et al. | 131/194 |
| 7,434,584 | B2 * | 10/2008 | Steinberg | 131/194 |

* cited by examiner

*Primary Examiner* — Richard Crispino
*Assistant Examiner* — Phu Nguyen

(57) ABSTRACT

A vaporization lighter flame casing is disclosed. The flame casing can include an attachment portion adapted to attach the flame casing to a lighter. The flame casing can also include a channel adapted to direct a hot air stream rising from a flame of the lighter when the lighter is lit. The flame casing can further include an outlet coupled to the channel through which the hot air stream exits the flame casing, where the outlet extends from the flame casing at an angle relative to the channel.

5 Claims, 9 Drawing Sheets

VAPORIZATION LIGHTER

RELATED APPLICATIONS

This application claims the benefit of U.S. Provisional Application No. 61/501,260, entitled "Vaporization Lighter," filed on Jun. 27, 2011, which is incorporated herein by reference in its entirety.

FIELD OF THE INVENTION

The present invention relates to vaporization devices, and more particularly to vaporization lighters and flame casings.

BACKGROUND OF THE INVENTION

Tobacco or other herbs are typically smoked by burning and inhaling the smoke. The smoke may be harmful to the smoker's health and may also affect those around the smoker. In response to these issues, many cities, states and the federal government have passed laws or created ordinances or rules that prohibit smoking in public places.

Vaporization may provide many benefits over traditional smoking. However, few smokers may vaporize because vaporization may be difficult to perform with the present vaporizers on the market. Conventional vaporizers may be inconvenient and/or expensive, and may require an electric or other power supply, time to wait for the device to heat, be relatively large in size, have many parts, be cumbersome to use and may need to be cleaned.

Vaporization could possibly be attempted using only a lighter. When a lighter is lit, even though the flame may be only ¼ inch to ½ inch tall, it can produce a hot air flow above the flame capable of vaporizing smoking material. However, the hot air flow can rapidly rise vertically and move with ambient air, making it difficult to locate the right position to inhale the right temperature hot air flow to vaporize smoking material.

DETAILED DESCRIPTION

Figure 1:
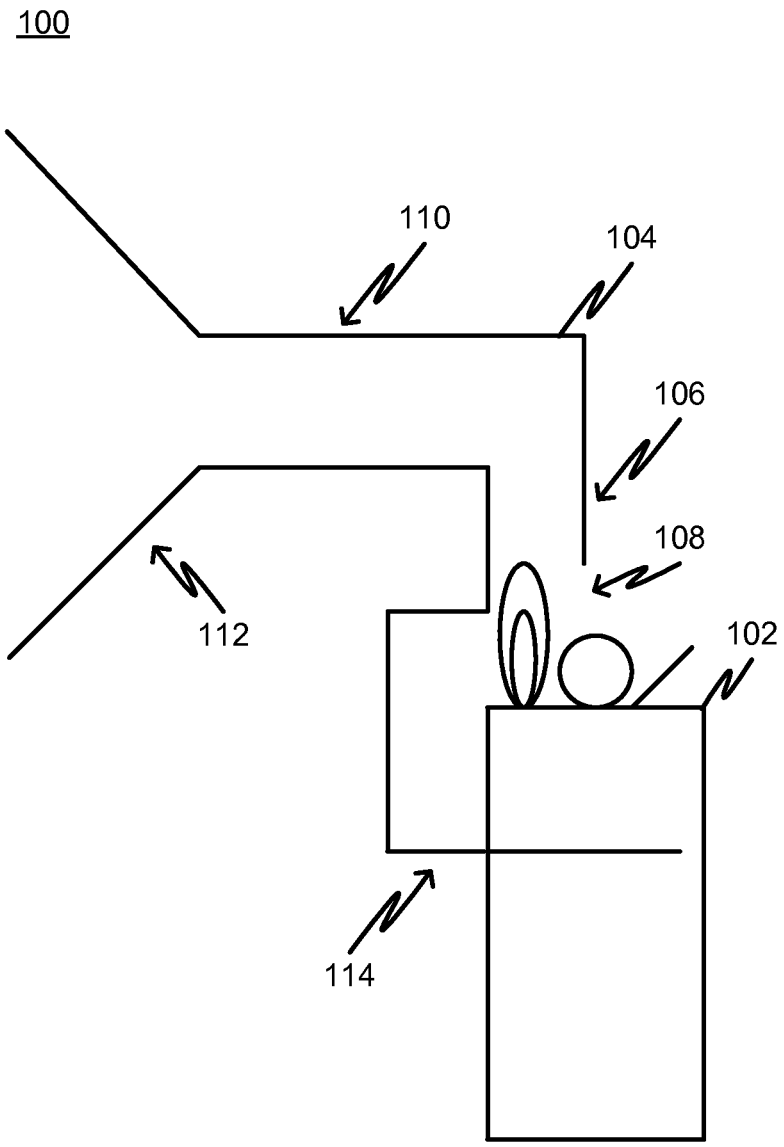
FIG. 1 shows a cross-sectional side view of an example vaporization lighter in accordance with at least one embodiment.

In general, an embodiment includes a vaporization lighter flame casing that can provide an intermediate temperature hot air stream capable of vaporizing, without burning, smoking material. The present invention relates to a vaporization lighter and/or flame casing that can provide a vaporization function.

An embodiment can include a vaporization lighter that can provide an intermediate temperature hot air stream that can be use for vaporizing smoking material. When the lighter flame is lit, the flame exhaust rises up in the flame casing and is directed out the air outlet and mixes with ambient air to produce an intermediate hot air stream.

In operation, a user should preferably keep the lighter flame vertical to help ensure the lighter fluid (e.g., fuel) is fully burned so the byproducts from the flame include $CO_2$ and $H_2O$, and put the hot air outlet near the smoking pipe (or other smoking material) and inhale. The intermediate temperature hot air stream produced by the vaporization lighter is drawn into the pipe and passes through the smoking material, creating a vapor that is then inhaled. By controlling the speed of inhalation, the distance between the smoking pipe (or other smoking material) and the hot air outlet, a user can modulate the temperature of the hot air stream. With experience, a user can obtain a desired temperature for vaporization, while not burning the smoking material.

In one embodiment, a vaporization lighter provides an intermediate temperature hot air stream (e.g., around 300-400 degrees F.) instead of a flame (e.g., above 1000 degrees F.). The intermediate temperature hot air stream capable of vaporizing, without burning, smoking material. The vaporization lighter can be fire proof, wind proof and/or smoke proof.

One embodiment includes a lighter with a flame casing structured around the flame. The flame casing closed the flame inside with air inlet on the bottom and air outlet on the top. Similar to an oil lamp's glass casing around the flame.

When the lighter flame is lit, a hot air stream rises up in the flame casing and is directed out the air outlet. The flame casing transfers the hot air stream from flame exhaust to the smoking material (e.g., loose tobacco or other leaf, cigar, cigarette or the like) and also permits mixing between the flame exhaust and ambient air.

By adjusting the size of the flame, the size of the flame casing, the size of the air inlet and the air outlet, a desired temperature range (below 400 degrees F.) hot air stream can be created. The lighter thereby creates an intermediate temperature hot air stream capable of vaporizing, without burning, smoking material.

In operation, a user can keep the flame vertical, put the hot air outlet near the smoking pipe and inhale, the intermediate temperature hot air stream is drawn into the pipe and passes through the smoking material, creating a vapor that is then inhaled. By controlling the speed of inhalation, the distance between the smoking pipe and the hot air outlet, a user can modulate the temperature of the hot air stream. With experience, a user can obtain a desired temperature for vaporization and smoking.

One embodiment includes a lighter with a flame casing structured around the lighter to capture and direct heat from the flame of the lighter. The flame casing transfers a hot air stream from the flame to the smoking material and also permits the flame exhaust and ambient air to mix. The flame casing thereby creates an intermediate temperature hot air stream capable of vaporizing the smoking material without igniting it or burning it.

An embodiment includes a lighter that can provide vaporization function. More specifically, the present invention can include a vaporization lighter that provides an intermediate temperature hot air stream instead of a flame, capable of vaporizing smoking material without burning it.

Another embodiment includes a lighter with a flame casing structured around the lighter near where a flame is produced. The flame casing encloses the flame inside at a bottom side and has an air outlet on a top side.

In operation, a user keeps the flame generally vertical and places the hot air outlet of the flame casing near the smoking pipe and inhales, the intermediate temperature hot air stream is drawn into the pipe and passes through the smoking material creating a vapor that is then inhaled. By controlling the speed of inhalation, the distance between the smoking pipe and the hot air outlet, a user can modulate the temperature of the hot air stream. With experience, a user can obtain a desired temperature for vaporization.

An embodiment can include a flame casing as a separate article that can be removably attached to a conventional lighter (e.g., a BIC disposable lighter). Once the lighter fuel is exhausted, the flame casing can be removed and placed onto a new lighter.

Also, it will be appreciated that the hot air outlet of the flame casing could be made facing any direction and at any suitable angle.

FIG. 1 shows a cross-sectional side view of an example vaporization lighter 100. In particular, the vaporization lighter 100 includes a lighter 102, a flame casing 104, a hot air inlet 106, and opening 108, a channel 110, an opening 112 for holding a cigar and an attachment portion 114 for attaching the flame casing 104 to the lighter 102 (either permanently or removably).

Figure 2:
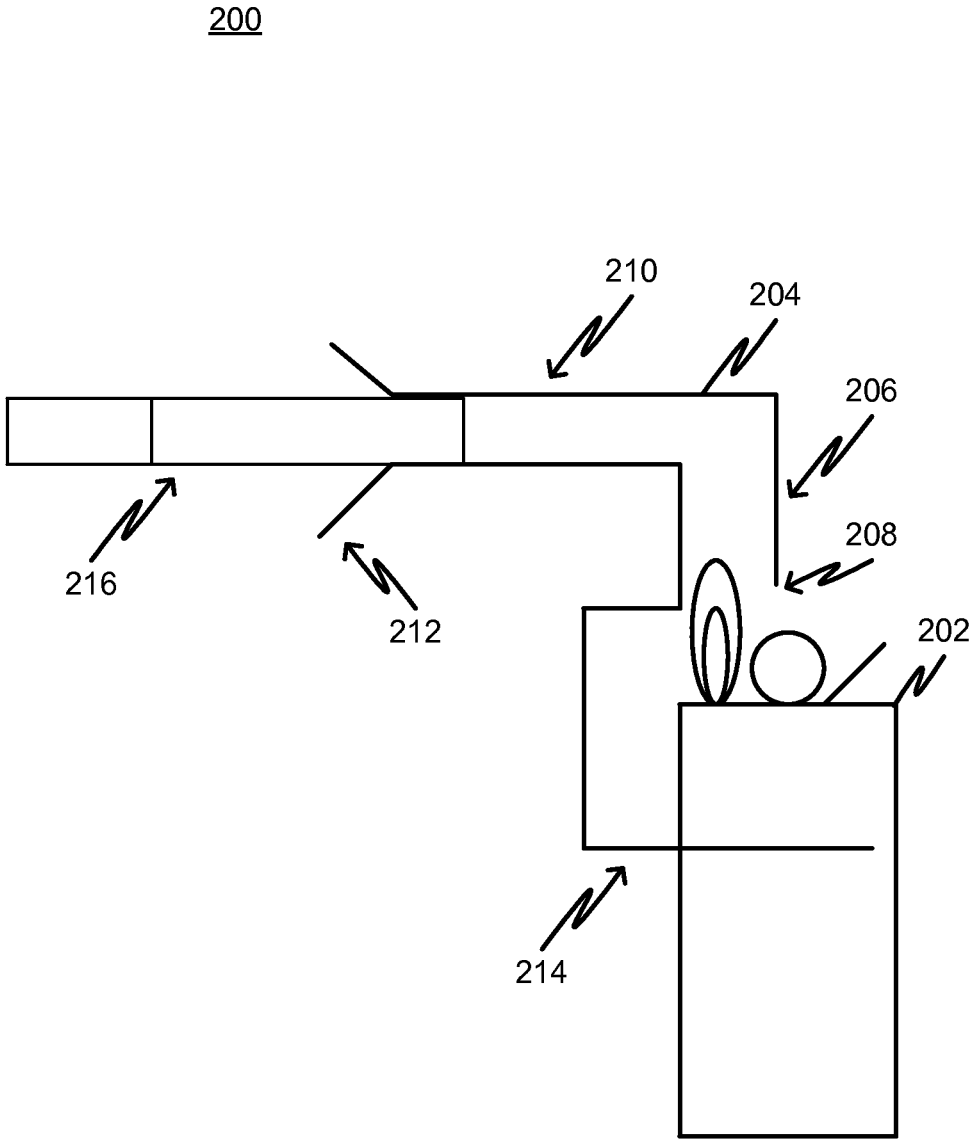
FIG. 2 shows an example cigarette vaporization lighter in accordance with at least one embodiment.

FIG. 2 shows an example cigarette vaporization lighter 200. In particular, the vaporization lighter 200 includes a lighter 202, a flame casing 204, a hot air inlet 206, an opening 208, a channel 210, an opening 212 for holding a cigarette 216, and attachment portion 214 for attaching the flame casing to the lighter (either permanently or removably).

Figure 3:
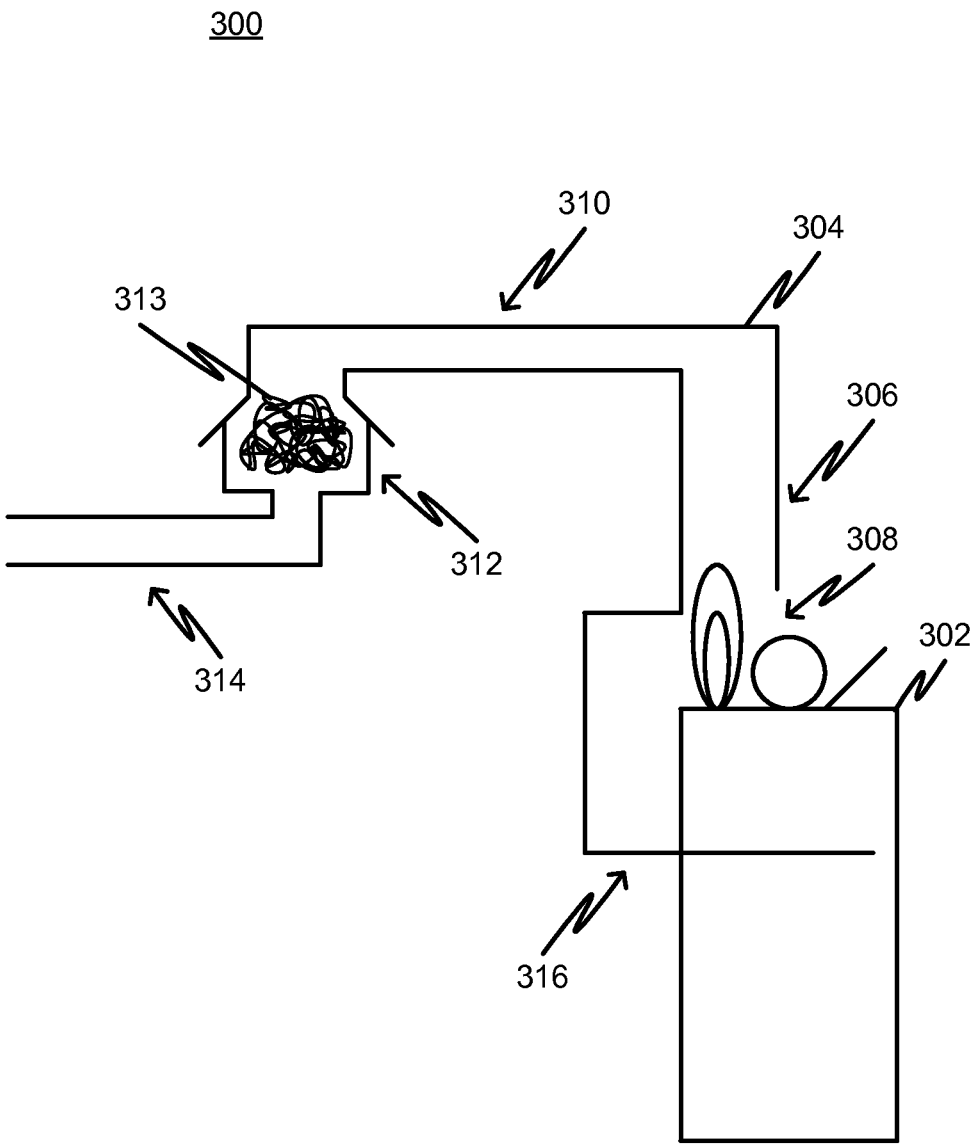
FIG. 3 shows an example pipe vaporization lighter in accordance with at least one embodiment.

FIG. 3 shows an example pipe vaporization lighter. In particular, a pipe vaporization lighter 300 includes a lighter 302, a flame casing 304, a hot air inlet 306, an opening 308, a channel 310, a pipe bowl 312 for holding smoking material 313, a mouthpiece 314 and an attachment portion 316 for attaching the flame casing 304 to the lighter 302 (either permanently or removably).

Figure 4:
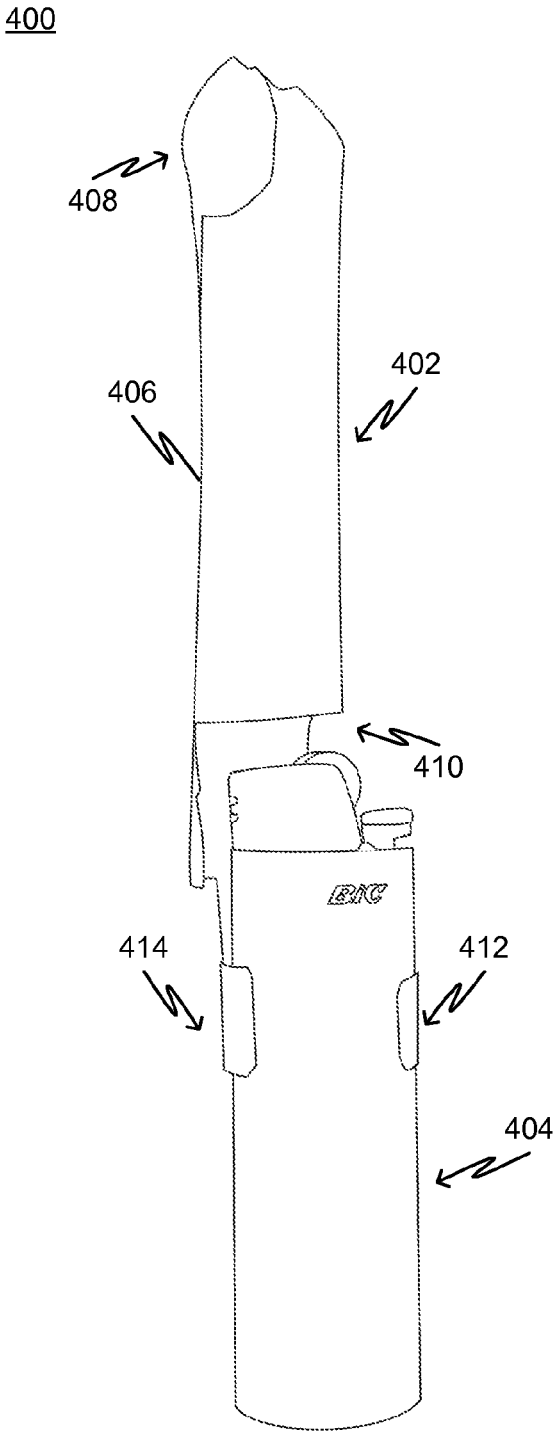
FIG. 4 is a diagram of a front view of an example vaporization lighter flame casing in accordance with at least one embodiment.
Figure 5:
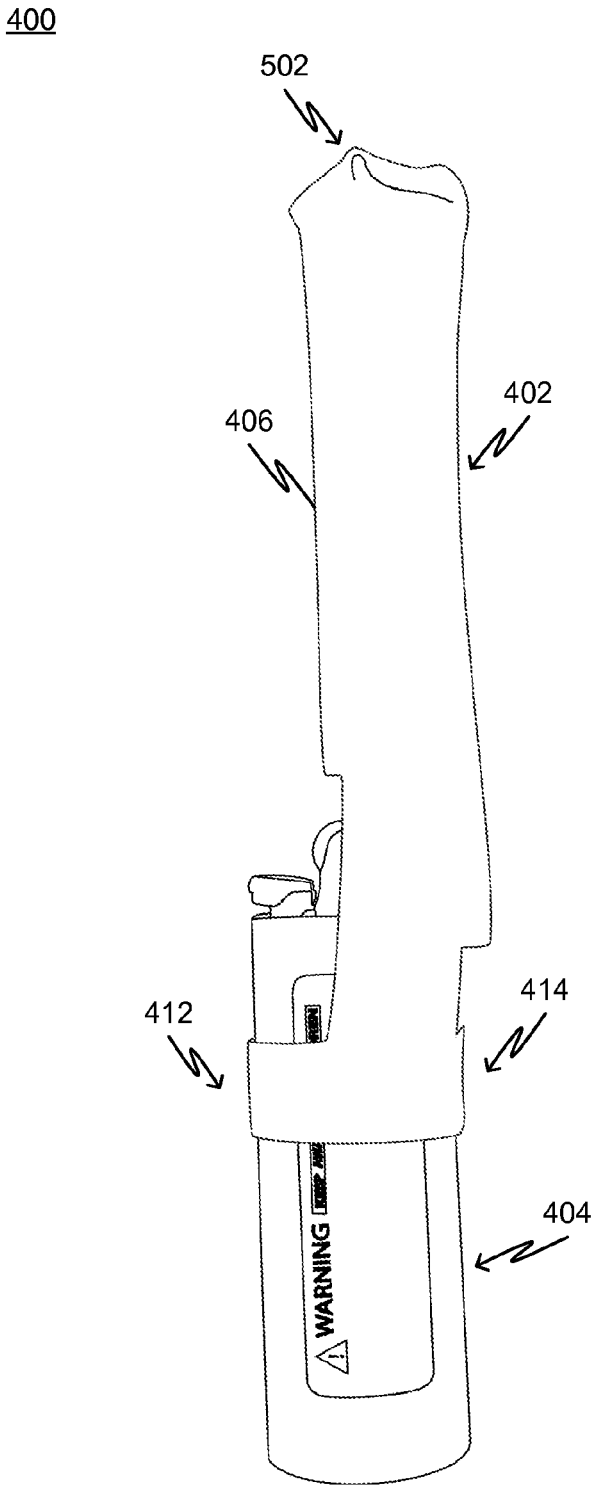
FIG. 5 is a diagram of a rear view of an example vaporization lighter flame casing in accordance with at least one embodiment.

FIGS. 4 and 5 are diagrams of front and rear views, respectively, of an example vaporization lighter 400 in accordance with at least one embodiment. The vaporization lighter 400 includes a flame casing 402 and a lighter 404. The flame casing 402 includes a hot air channel 406, an outlet 408, an opening 410 for receiving hot air, a first lighter attachment tab 412 and a second lighter attachment tab 414. FIG. 5 shows a bend (and/or fold) 502 in the metal to create the outlet portion 408 from the material (e.g., sheet metal) forming the flame casing 402.

Figure 6:
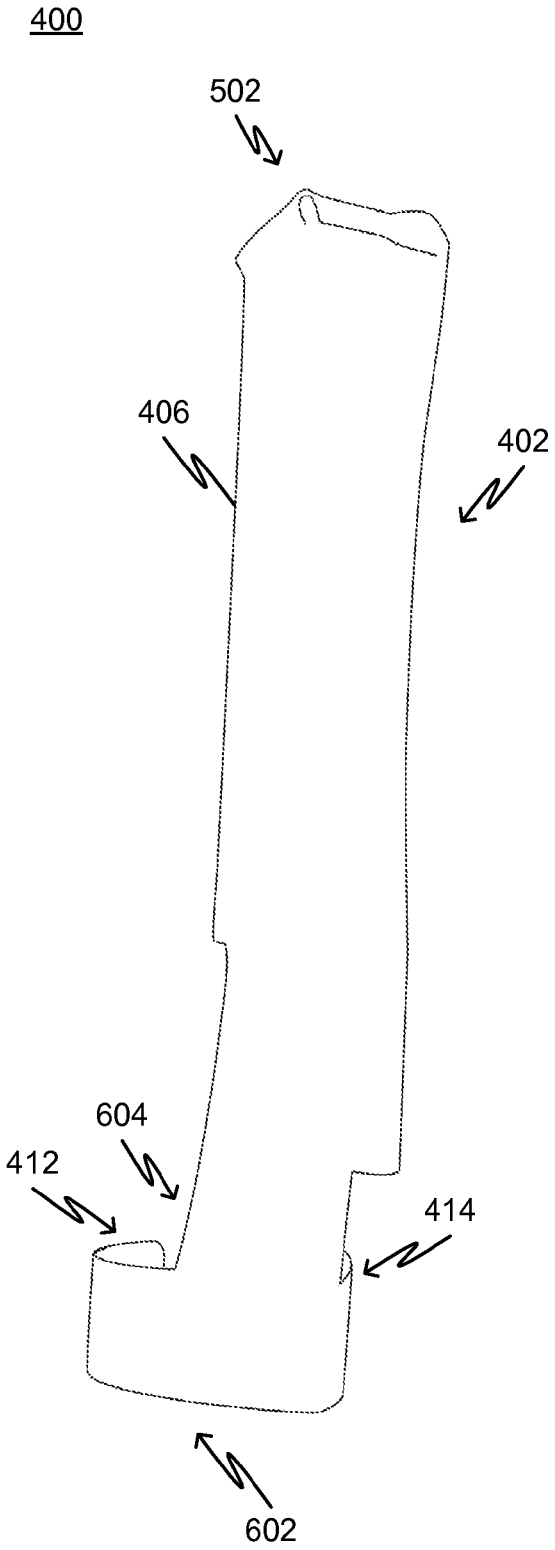
FIG. 6 is a diagram of a rear view of an example flame casing in accordance with at least one embodiment.
Figure 7:
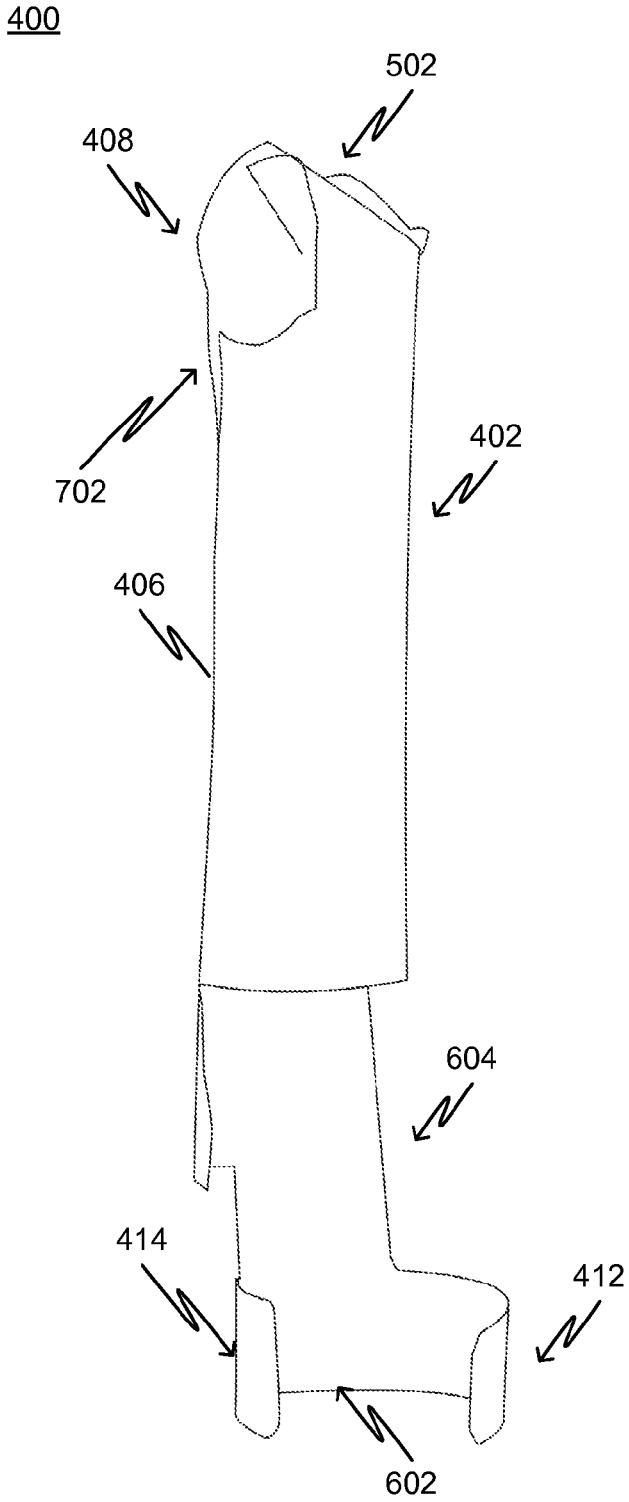
FIG. 7 is a diagram of a front view of an example flame casing in accordance with at least one embodiment.

FIGS. 6 and 7 are diagrams of rear and front views, respectively, of an example flame casing 400 without the lighter attached. In addition to the parts described above with respect to FIGS. 4 and 5, the flame casing 402 includes an attachment portion 602, to which the first attachment tab 412 and the second attachment tab 414 extend from. The flame casing 402 also includes an intermediate connection portion 604 that joins the attachment portion 602 to the channel 406. FIG. 7 shows a seam 702 where edges, of the material (e.g., sheet metal) used to form the flame casing, meet.

Figure 8:
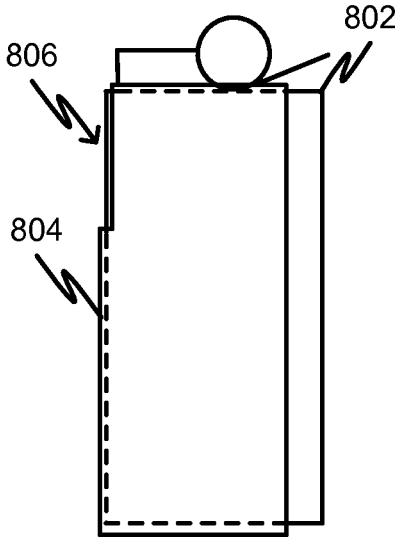
FIGS. 8 and 9 show an example vaporization lighter having a foldable flame casing.
Figure 9:
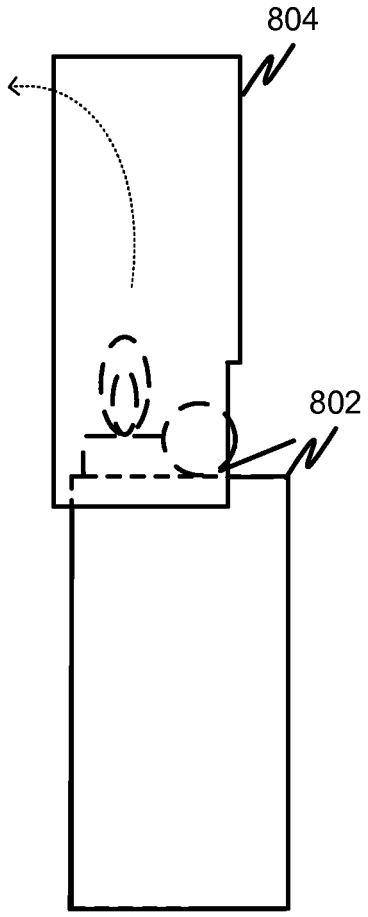

FIGS. 8 and 9 show a foldable embodiment of a vaporization lighter. In particular, a lighter 802 can be at least partially inserted into the foldable flame casing 804 when not in use. The flame casing 804 can be generally rectangular with one open side to accommodate the lighter. A portion (806) of the flame casing can be cut away to permit the casing to rotate (in an embodiment that rotates) up and over the top of the lighter.

In use, the foldable flame casing 804 can be moved to a position above the lighter (as shown in FIG. 9). The foldable flame casing can be rotated (via a rotational hinge coupling the channel of the flame casing and a lighter attachment portion), or removed and placed on top of the lighter. In general any method of attaching and providing for the flame casing to be moved from a first position in which the lighter is partially enveloped by the flame casing to a second position in which the flame casing is generally above the lighter, can be used.

Another embodiment can include a flame casing having a pipe-like channel connected to a first side of an angled member (e.g., a ninety degree elbow). An outlet portion of pipe can be connected to the second side of the angled member. The outlet can be circular. The channel can be connected to an attachment portion (similar to those described above) for attaching the flame casing to a lighter.

Another embodiment can include a movable outlet that can be rotated about a vertical axis and/or moved to different angles relative to the channel. The movement can be accomplished by a flexible member between the channel and outlet, by hinges and/or the like, or a combination of the above.

Any of the embodiments described above can be made (or adapted) to work with a standard size disposable lighter (e.g., a BIC lighter measuring approximately 1 inch by 3 inches), a standard size refillable lighter (e.g., measuring approximately 1 inch by 3 inches), or a miniature disposable lighter (e.g., a mini BIC measuring approximately ¾ inch by 2¼ inches). In general, an embodiment can be made or adapted to fit any type of disposable or refillable cigarette or cigar lighter.

In addition to metal or glass, a flame casing for any of the embodiments described above can be made from ceramic material or a fiber-based material that is fire proof or fire resistant. For example, an embodiment can be made from fire proof paper, paper lined with foil, or the like. In general, any material that can withstand the temperatures associated with the flame casing when in use and which can be formed to the desired shape can be used. Embodiments can be reusable or disposable.

It is, therefore, apparent that there is provided, in accordance with the various embodiments disclosed herein, vaporization lighters, flame casings and methods for making the same.

While the invention has been described in conjunction with a number of embodiments, it is evident that many alternatives, modifications and variations would be or are apparent to those of ordinary skill in the applicable arts. Accordingly, Applicants intend to embrace all such alternatives, modifications, equivalents and variations that are within the spirit and scope of the invention.

What is claimed is:

1. A vaporization lighter, comprising:

a lighter having a fuel source, an igniter and a fuel outlet;

a flame casing integrated with the lighter to direct a hot air stream produced by a flame from the lighter when fuel from the fuel source is released from the fuel outlet and is ignited by the igniter, the flame casing including a vertical channel extending from the fuel outlet that directs the hot air stream and an angled outlet through which the hot air stream exits the flame casing and mixes with ambient air to generate an intermediate hot air stream to vaporize smoking material without burning the smoking material, the angled outlet includes a covering having one or more small holes disposed inside the angled outlet and covering an inside area of the angled outlet adapted to prevent an object from being inserted into the flame casing; and a pipe bowl having a first end adapted to be coupled to the channel and a second end adapted to provide a pipe mouth piece, the smoking material held in the pipe bowl.

2. The vaporization lighter of claim 1, further comprising a heat resistant shield disposed on an exterior of the flame casing.

3. The vaporization lighter of claim 1, further comprising an adjustable opening adjacent a hot air intake portion of the channel, the opening adapted to permit ambient air to mix with the hot air stream.

4. The vaporization lighter of claim 1, wherein the flame casing is made of metal.

5. The vaporization lighter of claim 1, wherein the flame casing is made of glass.

* * * * *